US009838798B2

(12) United States Patent
Mao et al.

(10) Patent No.: US 9,838,798 B2
(45) Date of Patent: Dec. 5, 2017

(54) LONG STROKE SPEAKER

(71) Applicants: Lubin Mao, Shenzhen (CN); Hongxing Wang, shenzhen (CN)

(72) Inventors: Lubin Mao, Shenzhen (CN); Hongxing Wang, shenzhen (CN)

(73) Assignee: AAC TECHNOLOGIES PTE. LTD., Sinagpore (SG)

( * ) Notice: Subject to any disclaimer, the term of this patent is extended or adjusted under 35 U.S.C. 154(b) by 0 days.

(21) Appl. No.: 15/295,006

(22) Filed: Oct. 17, 2016

(65) Prior Publication Data

US 2017/0127187 A1 May 4, 2017

(30) Foreign Application Priority Data

Nov. 4, 2015 (CN) ..... 2015 2 0872120 U

(51) Int. Cl.
*H04R 9/06* (2006.01)
*H04R 9/02* (2006.01)

(52) U.S. Cl.
CPC ..... *H04R 9/063* (2013.01); *H04R 9/025* (2013.01)

(58) Field of Classification Search
CPC ..... H04R 5/02; H04R 1/02; H04R 1/2842; H04R 1/347; H04R 1/2819; H04R 1/403; H04R 1/2811; H04R 2205/024; H04R 2205/022
USPC ..... 381/335, 345, 347, 348, 351
See application file for complete search history.

(56) References Cited

U.S. PATENT DOCUMENTS

2011/0170736 A1* 7/2011 Li ..... H04R 9/06 381/401
2015/0304747 A1* 10/2015 Wang ..... H04R 5/02 381/345

* cited by examiner

*Primary Examiner* — Melur Ramakrishnaiah
(74) *Attorney, Agent, or Firm* — Na Xu; IPro, PLLC

(57) ABSTRACT

A long stroke speaker is provided in the present disclosure. The long stroke speaker includes a shell having a receiving space, a first vibration system and a second vibration system connected with the shell respectively, and at least one magnetic circuit system. The receiving space comprises a first acoustic cavity and a second acoustic cavity communicated with each other. The magnetic circuit system(s) is(are) disposed in the first acoustic cavity and/or the second acoustic cavity. The vibration direction of the first vibration system intersects with the vibration direction of the second vibration system.

10 Claims, 5 Drawing Sheets

LONG STROKE SPEAKER

FIELD OF THE DISCLOSURE

The present invention relates to a speaker, and in particular, relates to a long stroke speaker.

BACKGROUND

In recent years, with the development of science and technology, especially the remarkable development of mobile communication technology, more and more mobile electronic devices appear in people's daily life, such as smart phone, tablet computer, notebook computer and multifunction media player and have already become indispensable personal belongings in people's life. In these mobile electronic devices, voice playing devices are essential components therein. The voice quality can directly affect users' experience when they use these mobile electronic devices.

As a voice playing device, the structure and design of the long stroke speaker can directly affect the voice playing quality. The long stroke speaker in prior art only has unidirectional sound emission, and must have a cavity with certain volume in order to meet the performance requirement.

In application, when the long stroke speaker needs to emit sound in other direction, it must be provided with a conventional speaker and needs a rear cavity with certain volume, which occupies considerable space and also increases cost.

Therefore, it is desired to provide a new long stroke speaker which can overcome the aforesaid problems.

BRIEF DESCRIPTION OF THE DRAWINGS

Many aspects of the embodiment can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will be described in detail below with reference to the attached drawings and the embodiment thereof.

Figure 1:
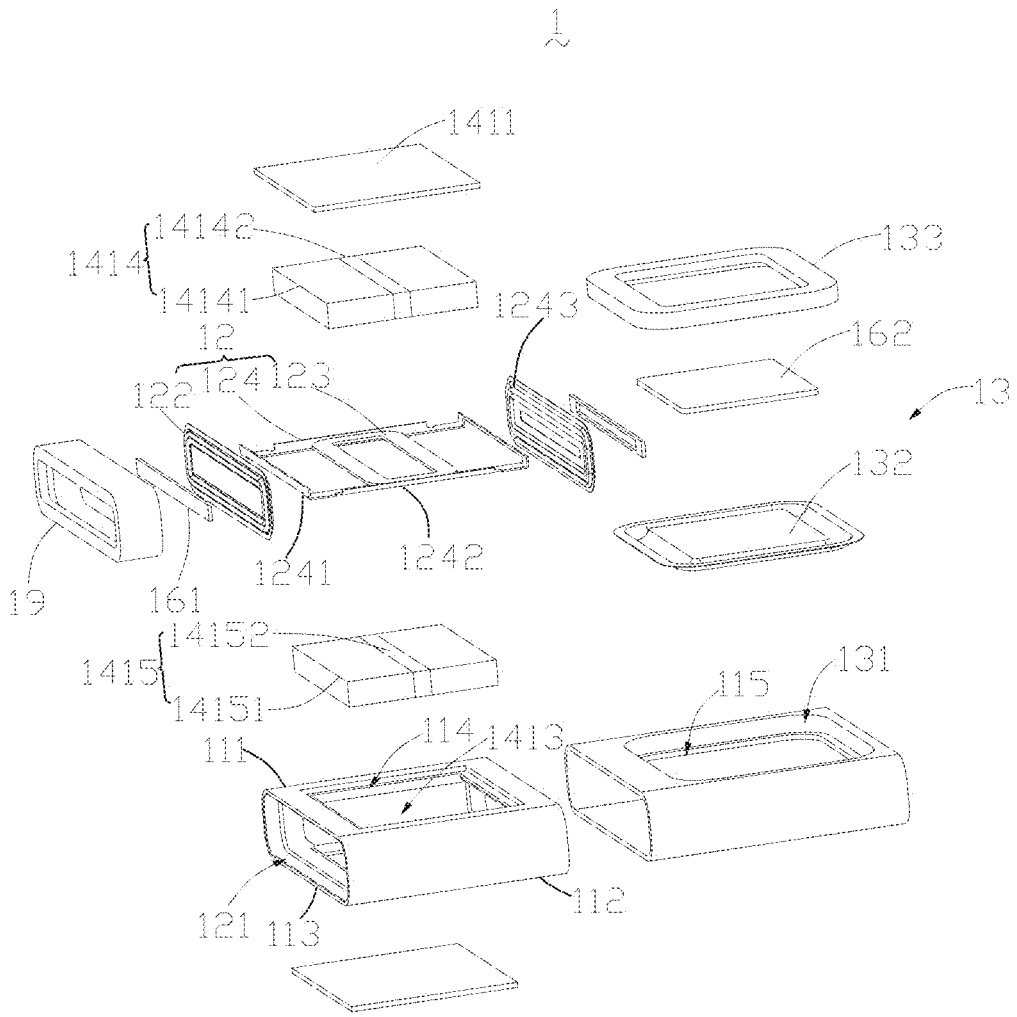
FIG. 1 is an exploded view showing a long stroke speaker according to an embodiment of the present invention.
Figure 2:
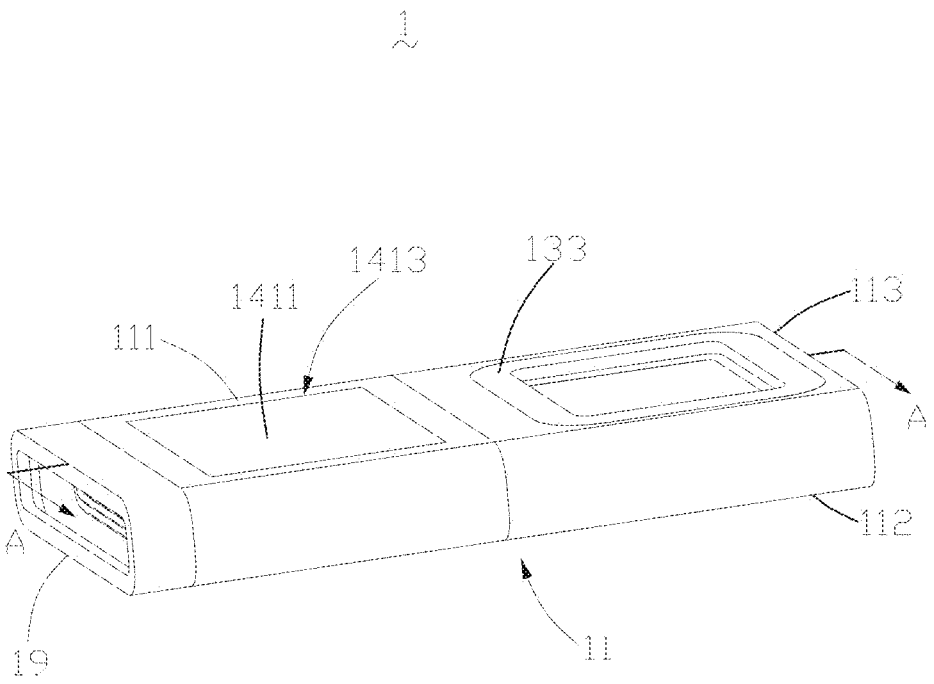
FIG. 2 is a perspective view of the long stroke speaker shown in FIG. 1.
Figure 3:
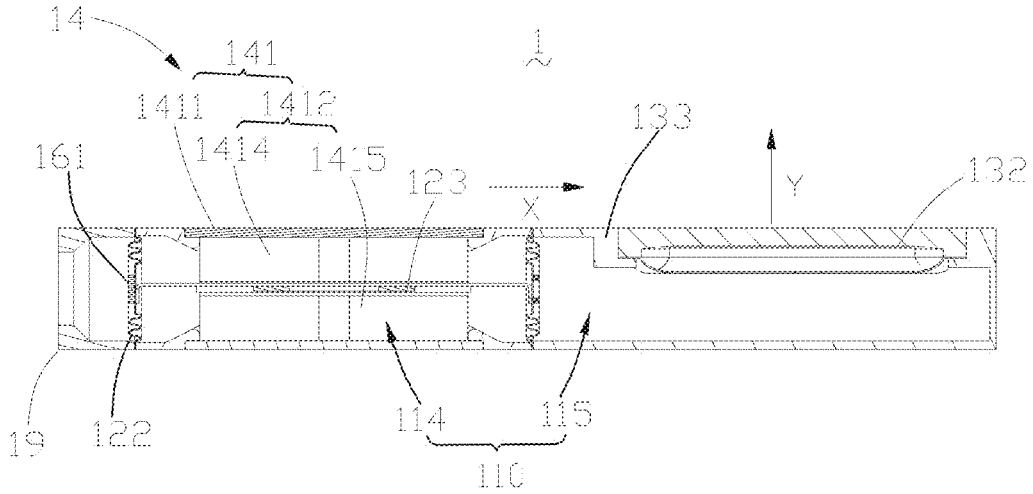
FIG. 3 is a sectional view of the long stroke speaker shown in FIG. 2 taken along A-A.

Referring to FIGS. 1-3, a long stroke speaker 1 comprises a shell 11 having a receiving space 110; a first vibration system 12 and a second vibration system 13 connected with the shell 11 respectively; a magnetic circuit system 14 and a sound output ring 19. The receiving space 110 comprises a first acoustic cavity 114 and a second acoustic cavity 115 communicated with each other. The vibration direction of the first vibration system 12 intersects with the vibration direction of the second vibration system 13. For ease of description, the vibration direction of the first vibration system 12 is called X direction; and the vibration direction of the second vibration system 13 is called Y direction.

The shell 11 comprises a first side wall 111, a second side wall 112 opposite to the first side wall 111, and several third side walls 113 connected with the first side wall 111 and the second side wall 112. The first side wall 111, the second side wall 112 and the third side walls 113 enclose a receiving space 110 together. The third side walls 113 is provided with a first receiving portion 121 for receiving the first vibration system 12. The first side wall 111 or the second side wall 112 is provided with a second receiving portion 131 for receiving the second vibration system 13. In this embodiment, the third side walls 113 are connected with and perpendiculars to the first side wall 111 and the second side wall 112, and the X direction and the Y direction intersect to each other perpendicularly.

The first vibration system 12 comprises a first diaphragm 122, a coil 123 and a support 124 for supporting the first diaphragm 122 and the coil 123. The support 124 comprises a first support portion 1241 received in the first receiving portion 121 and connected with the third side wall 113; a second support portion 1242 extending from the first support portion 1241 along the X direction; and a barrier portion 1243 connected with the second support portion 1242. The first diaphragm 122 is connected with the first support portion 1241. The coil 123 is disposed on the second support portion 1242. The two ends of the barrier portion 1243 are connected with the first side wall 111 and the second side wall 112 respectively so as to divide the receiving space 110 into a first acoustic cavity 114 and a second acoustic cavity 115 communicated with each other.

The second vibration system 13 comprises a second diaphragm 132 disposed in the second receiving portion 131 and a hollow cover plate 133. The second diaphragm 132 is located under the hollow cover plate 133.

Furthermore, each of the first diaphragm 122 and the second diaphragm 132 comprises a corrugation portion and a flat portion. The corrugation portion is around the flat portion. The corrugation portion can support larger amplitude. The first vibration system 12 also comprises a first dome 161 attached on the first diaphragm 122. The second vibration system 13 also comprises a second dome 162 attached on the second diaphragm 132.

In this embodiment, there is one magnetic circuit system 14, which is disposed in the first acoustic cavity 114. Specifically, the magnetic circuit system 14 comprises a pair of magnetic steel assemblies 141 spaced apart and connected with the first side wall 111 and the second side wall 112 respectively. The coil 123 of the first vibration system 12 and the second support portion 1242 are interposed between the magnetic steel assemblies 141. Each of the magnetic steel assemblies 141 comprises a magnetic steel block 1412 and a pole plate 1411 stacked on the magnetic steel block 1412. The first side wall 111 and the second side wall 112 are provided with through holes 1413 for receiving the pole plate 1411.

The magnetic steel blocks 1412 of the magnetic steel assemblies 141 disposed at two sides of the coil 123 are a first magnet portion 1414 and a second magnet portion 1415, wherein each of the first magnet portion 1414 and the second magnet portion 1415 comprises two main magnetic steel blocks and an auxiliary magnetic steel block interposed between the two main magnetic steel blocks. Specifically, the first magnet portion 1414 comprises two first main magnetic steel blocks 14141 and a first auxiliary magnetic steel block 14142, wherein the first auxiliary magnetic steel block 14142 is interposed between the two first main magnetic steel blocks 14141. The second magnet portion 1415 comprises two second main magnetic steel blocks 14151 and a second auxiliary magnetic steel block 14152, wherein the second auxiliary magnetic steel block 14152 is interposed between two second main magnetic steel blocks 14151.

The sound output ring 19 is disposed around the first diaphragm 122 and forms a sound output cavity for the first diaphragm 122 so that the long stroke speaker 1 can have better sound output effects.

Figure 4:
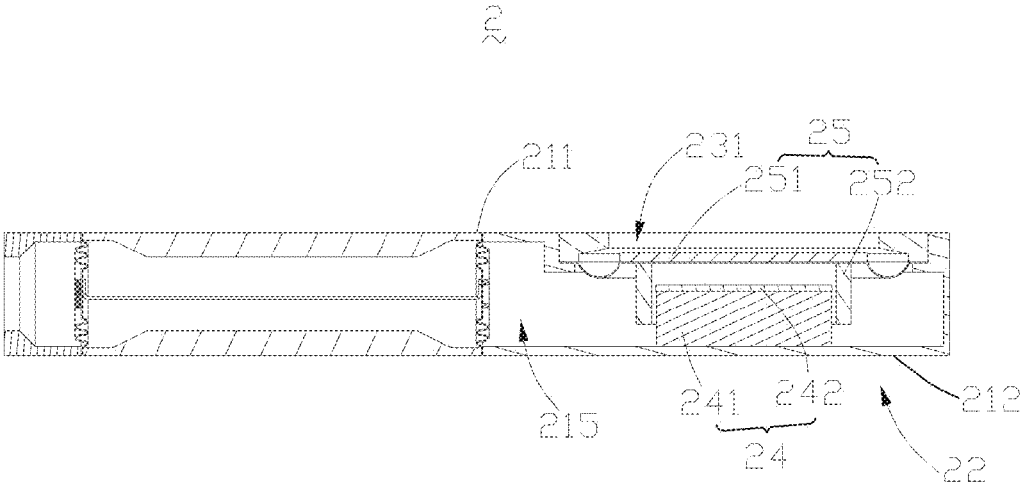
FIG. 4 is a sectional view of a long stroke speaker according to another embodiment of the present invention.

Referring to FIG. 4, it is a sectional view of a long stroke speaker according to another embodiment of the present invention. In the present embodiment, there is one magnetic circuit system 24, which is disposed in the second acoustic cavity 215. A second receiving portion 231 is provided on the first side wall 211.

The magnetic circuit system 24 comprises a magnetic steel block 241 fixed on the second side wall 212 and a pole core 242 attached on the magnetic steel block 241.

The second vibration system 25 comprises a second diaphragm 251 received in the second receiving portion 231 and a voice coil 252 connected with the second diaphragm 251. The voice coil 252 is located under the second diaphragm 251 and is disposed around the magnetic steel block 241.

At least a portion of the second side wall 212 is made of permeability material. The magnetic steel block 241 is connected with that portion of the second side wall 212 made of permeability material.

Figure 5:
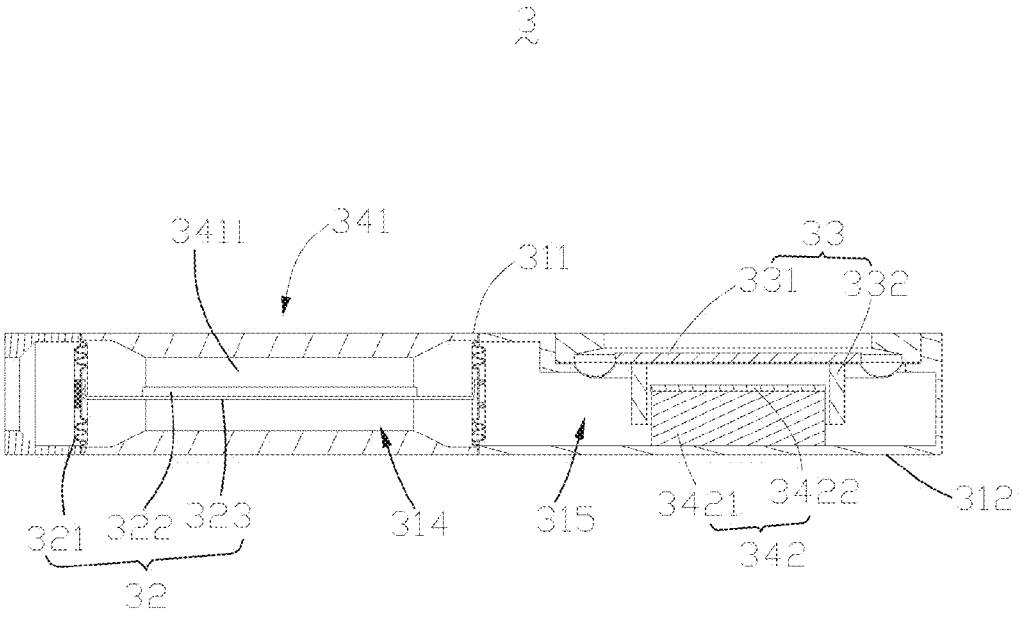
FIG. 5 is a sectional view of a long stroke speaker according to yet another embodiment of the present invention.

Referring to FIG. 5, it is a sectional view of a long stroke speaker according to yet another embodiment of the present invention. In this embodiment, there are two magnetic circuit systems 34, a first magnetic circuit system 341 disposed in the first acoustic cavity 314 and a second magnetic circuit system 342 disposed in the second acoustic cavity 315, respectively.

The first magnetic circuit system 341 comprises a pair of magnetic steel assemblies 3411 connected with the first side wall 311 and the second side wall 312 respectively. The second magnetic circuit system 342 comprises a magnetic steel block 3421 disposes on the second side wall 312 and a pole core 3422 connected with the magnetic steel block 3421. The first vibration system 32 comprises a first diaphragm 321, a coil 322 disposed between the pair of magnetic steel assemblies 3411 and a support 323 for supporting the first diaphragm 321 and the coil 322. The coil 322 is interposed between the magnetic steel assemblies 3411. The second vibration system 33 comprises a second diaphragm 331 received in the second receiving system 33 and a voice coil 332 connected with the second diaphragm 331. The voice coil 332 is disposed around the magnetic steel block 3421.

When the long stroke speaker according to the present invention emits sound through the vibration of the first vibration system in the first acoustic cavity, because of the change of the air volume in the second vibration system in the second acoustic cavity, the second vibration system can be driven to vibrate, realizing the sound emission of the second acoustic cavity. That is to say, one magnetic circuit system can realize bidirectional sound emission of the first acoustic cavity and the second acoustic cavity simultaneously without adding a conventional speaker, which can greatly save space and reduce cost.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A long stroke speaker, comprising:

a shell having a first side wall, a second side wall opposite to the first side wall, and several third side walls connected with the first side wall and the second side wall forming a receiving space and a first receiving portion, a second receiving portion provided on the first side wall and communicated with the receiving space;

a first vibration system received in the receiving space and having a first diaphragm located in the first receiving portion, a magnetic circuit system, a support and a coil assembled with the support received in the magnetic circuit system for driving the first diaphragm to vibrate along a direction paralleled to an elongated axis of the shell, a barrier portion mounted on the support far away from the first diaphragm, a first acoustic cavity formed by the first diaphragm and the barrier portion and a part of the shell;

a second vibration system received in the receiving space and having a second diaphragm disposed in the second receiving portion so as to attach with the first side wall, a second acoustic cavity formed by the barrier portion and the second diaphragm and another part of the shell;

the first acoustic cavity communicated with the second acoustic cavity each other;

the second diaphragm having a vibrating sound direction perpendicularly to the elongated axis of the shell.

2. The long stroke speaker of claim 1, wherein the magnetic circuit system has a first magnet portion, a second magnet portion opposite to and apart from the first magnet portion for forming a magnetic gap, the support received in the magnetic gap.

3. The long stroke speaker of claim 2, wherein each of the first magnet portion and the second magnet portion include two main magnetic steel blocks, a auxiliary magnetic steel block sandwiched between the first magnet portion and the second magnet portion.

4. The long stroke speaker of claim 3, wherein each of the first side wall and the second side wall provide a through hole, two pole plates are respectively received in the through holes, and the first magnet portion and the second magnet portion are located on the corresponding pole plates, respectively.

5. The long stroke speaker of claim 3, wherein the second vibration system further includes a hollow cover plate covering on the second diaphragm.

6. A long stroke speaker, comprising:

a shell having a first side wall, a second side wall opposite to the first side wall, and several third side walls connected with the first side wall and the second side wall forming a receiving space and a first receiving portion, a second receiving portion provided on the first side wall and communicated with the receiving space;

a first vibration system received in the receiving space and having a first diaphragm located in the first receiving portion, a barrier portion and a support located between the first diaphragm and the barrier portion along a direction paralleled to an elongated axis of the shell, a first acoustic cavity formed by the first diaphragm and the barrier portion and a part of the shell;

a second vibration system received in the receiving space and having a second diaphragm disposed in the second receiving portion so as to attach with the first side wall, a voice coil connected with the second diaphragm, a second acoustic cavity formed by the barrier portion and the second diaphragm and another part of the shell, a magnetic circuit system disposed in the second acoustic cavity for driving the voice coil;

the first acoustic cavity communicated with the second acoustic cavity each other;

the second diaphragm having a vibrating sound direction perpendicularly to the elongated axis of the shell.

7. A long stroke speaker, comprising:

a shell having a first side wall, a second side wall opposite to the first side wall, and several third side walls connected with the first side wall and the second side wall forming a receiving space and a first receiving portion, a second receiving portion provided on the first side wall and communicated with the receiving space;

a first vibration system received in the receiving space and having a first diaphragm located in the first receiving portion, a magnetic circuit system, a support and a coil assembled with the support for driving the first diaphragm to vibrate along a direction paralleled to an elongated axis of the shell, a barrier portion mounted on the support far away from the first diaphragm, a first acoustic cavity formed by the first diaphragm and the barrier portion and a part of the shell;

a second vibration system received in the receiving space and having a second diaphragm disposed in the second receiving portion so as to attach with the first side wall, a voice coil connected with the second diaphragm, a second acoustic cavity formed by the barrier portion and the second diaphragm and another part of the shell, a magnetic circuit system disposed in the second acoustic cavity for driving the voice coil;

the first acoustic cavity communicated with the second acoustic cavity each other;

the second diaphragm having a vibrating sound direction perpendicularly to the elongated axis of the shell.

8. The long stroke speaker of claim 7, wherein the magnetic circuit system has a first magnet portion, a second magnet portion opposite to and apart from the first magnet portion for forming a magnetic gap, the support received in the magnetic gap.

9. The long stroke speaker of claim 8, wherein the second vibration system further includes a hollow cover plate covering on the second diaphragm.

10. The long stroke speaker of claim 9, wherein the magnetic circuit system of the second vibration system has a magnetic steel block disposes on the second side wall and a pole core connected with the magnetic steel block.

* * * * *